US006155005A

United States Patent [19]

McNamara

[11] Patent Number: 6,155,005

[45] Date of Patent: Dec. 5, 2000

[54] LIFT-ASSISTED ENTRANCE TO AN EXTERNAL BASEMENT ENTRYWAY

[76] Inventor: John D. McNamara, 152 N. End Rd., Westport, Me. 04588-3004

[21] Appl. No.: 09/353,399

[22] Filed: Jul. 15, 1999

[51] Int. Cl.[7] ..... E02D 27/00

[52] U.S. Cl. ..... 52/169.6; 52/66

[58] Field of Search ..... 52/66, 72, 169.6

[56] References Cited

U.S. PATENT DOCUMENTS

| | | | |
|---|---|---|---|
| 2,174,989 | 10/1939 | Lyons . | |
| 2,686,340 | 8/1954 | Shepard et al. . | |
| 3,103,996 | 9/1963 | Wyatt, Jr. . | |
| 3,608,252 | 9/1971 | Bisson | 52/66 X |
| 5,600,921 | 2/1997 | Vardaro . | |
| 5,778,604 | 7/1998 | Snow | 52/66 |

FOREIGN PATENT DOCUMENTS

| | | | |
|---|---|---|---|
| 8501854 | 1/1987 | Netherlands | 52/72 |

OTHER PUBLICATIONS

BILCO Basement Door Brochure, The Bilco Company, New Haven, CT, 1993.

*Primary Examiner*—Jerry Redman

*Attorney, Agent, or Firm*—Thomas L. Bohan; Patricia M. Mathers

[57] ABSTRACT

A lift-assisted entrance to provide ground-level access to an external basement entryway to a building. The lift-assisted entrance has a pivotable roof vertical, rectangular side walls, and a front face with vertically oriented, outward opening double doors, all fabricated from lightweight visco-elastic material. The roof section opens upward and tilts away from the plane of the front face and is supported by two actuators. Doors located on the front face open outward to provide full access to the basement entryway. The roof is shaped to reflect the architectural features or the style of the building to which the lift-assisted entrance is attached and may be a gabled roof The side walls and front face may also include architectural features—such as windows—that emulate those features found on the building. The visco-elastic material can be molded with a relief pattern that emulates the appearance of house shingles or clapboard siding, or roof shingles.

17 Claims, 3 Drawing Sheets

LIFT-ASSISTED ENTRANCE TO AN EXTERNAL BASEMENT ENTRYWAY

BACKGROUND OF THE INVENTION

1. Field of the Invention

This invention relates to an outdoor entry to a building. More particularly, the present invention relates to a lift-assisted entrance covering an entryway to that portion of a building that is located below ground level. Yet more particularly, the invention relates to a lift-assisted entrance that provides easy, simple access to the below-ground-level entryway to a building. Still more particularly, the present invention relates to such a lift-assisted entrance that is constructed from lightweight, durable materials. Finally, the present invention relates to such a lift-assisted entrance that is functionally and architecturally compatible with the design of the above-ground portion of the building to which it is attached.

2. Description of the Prior Art

It is not uncommon for building to have a level—such as a basement or cellar—situated below the level or grade, of the ground surrounding the structure. Residential buildings in particular are constructed such that the principal living space is located above ground, while the basement is almost entirely underground. Access to the basement—or subterranean level—is often gained through the interior of the building, usually by way of a stairway.

It is frequently desirable, however, to have access to the basement level of a building directly from the outdoors. For example, the basement commonly serves as a storage area for various types of goods and equipment—including lawn furniture and gardening tools—designed for outdoor use, or for other bulky items. Frequently, such cumbersome items may not be easily removed from storage via an interior access-way. A basement entryway is typically constructed to provide access to the basement level from the outdoors by putting a doorway in the outer concrete or masonry wall of the basement and constructing foundation walls on the outside of the basement doorway. The foundation walls extend from below the floor level of the basement doorway up to slightly above ground level and create a space in which to construct a stairway that descends from the top of the foundation wall opposite the basement doorway down to the floor level of the basement doorway. Unless protected by an external structure, this access to the basement entryway, however, can result in serious damage to the overall building by exposing the basement to the elements, particularly water. In colder climates, it is also desirable to keep the steps of such an entryway dear from any ice or snow that may accumulate and pose a hazard to a person attempting to use the outdoor stairway. Furthermore, it is desirable to prevent unauthorized access to the building by animals and human intruders through such an outdoor entryway. Typically, a bulkhead is installed above the basement entryway. These assemblies have numerous other names, such as cellar doors, cellar hatchway doors, basement doors, or hatches. For the sake of simplicity, I shall refer to the external protective door assembly of the prior art that is installed above a basement entryway as a bulkhead.

The ubiquitous BILCO BASEMENT DOOR of The Bilco Co. is a well-known bulkhead that is typically installed above a basement entryway of a residential building. This bulkhead is very similar in design to the bulkhead disclosed by Lyons (U.S. Pat. No. 2,174,989; issued 1939). Both devices have a pair of doors mounted in a frame that is attached to an outer masonry or concrete wall of the main building and to a basement entryway foundation. The frame and the doors slope downward away from the main building to grade level and are generally made of heavy gauge sheet metal, although, in the past, some bulkheads of this design were made of wood. Being constructed of heavy gauge sheet metal, the doors of the Lyons device and the BILCO device are heavy and unwieldy. No means for assisting in the opening and lifting of the doors is provided. The absence of any such assisting mechanism exposes the user to unnecessary strain and to risk of injury. The user must bend down to grasp the door handle, which is just a few inches above grade, and pull up to lift the door. The typical weight for the two standard sizes of the BILCO installation, for example, is reported as 175 lbs. and 196 lbs. respectively. The weight of a single door panel to be lifted is approximately 44 lbs and 49 lbs, respectively. Lifting this weight from a bent over position puts an unhealthful strain on the lower back. Furthermore, if the door should suddenly drop down to a closed position, the potential for serious injury to a person standing in the entryway is great.

Several attempts have been made to overcome the problem of having to lift the entire weight of the door. Wyatt (U.S. Pat. No. 3,103,996; issued 1963) discloses a hatchway door that is similar in shape to the BILCO and Lyons devices, but employs binge and spring elements to bias doors toward an open position, thereby partially assisting the user in opening the doors. Sbepard et al. (U.S. Pat. No. 2,686,340; issued 1954) discloses a self-balancing hatchway door. This device includes a single, downwardly sloping door pivotally connected to tension springs that assist the user in both opening and closing the door, as well as in balancing the door in an intermediate position. All of these bulkheads, i.e., the bulkheads disclosed by BILCO, Lyons, Wyatt and Shepard et al., are constructed of heavy-gauge steel and are consequently very heavy. The weight of the door alone poses a safety risk to the user, even if some means of lift-assist are provided. An open door that weighs over 40 lbs. can cause considerable injury to a person should it suddenly drop shut, for example because the lift-assist means failed or was accidentally tripped to close, or because the door was blown shut by a sudden gust of wind.

Vardaro (U.S. Pat. No. 5,600,921; issued 1997) discloses a bulkhead that includes a downwardly sloping, single fiberglass door and pneumatic struts that assist the user in opening the door. The door is of necessity quite large and unwieldy, albeit lightweight. The Vardaro device, as well as the Shepard et al. device, both of them being designed with a single, flat door that opens upward, may obstruct headroom and force the user to duck when ascending from or descending into the stairway.

Beyond the structural shortcomings of each of the above-mentioned devices, the prior-art bulkheads serve a utilitarian function but are aesthetically displeasing and unsightly. Having an outer appearance consisting of typically a flat, downwardly-sloping sheet metal surface, no effort has been made to reconcile the utility of such devices with the overall architectural schemes of the buildings they serve.

Therefore, what is needed is an lift-assisted entrance that will protect a subterranean basement entryway from the elements of the weather when it is closed. What is further needed is such a lift-assisted entrance that will provide easy access to the subterranean basement entry. What is yet further needed is such a lift-assisted entrance that can be used without posing the risk of injury or strain to the user. Finally, what is needed is such a lift-assisted entrance that is architecturally compatible with the principal building to which it is attached.

SUMMARY OF THE INVENTION

It is an object of the present invention to provide a lift-assisted entrance that will protect a subterranean basement entryway from the elements of the weather. It is a further object of the present invention to provide such a lift-assisted entrance that will allow easy access to the subterranean basement entryway. It is a yet further object of the present invention to provide such a lift-assisted entrance that can be used without posing the risk of injury or strain to the user. Finally, it is an object of the present invention to provide such a lift-assisted entrance that is architecturally compatible with the principal building to which it is attached.

The present invention meets these objectives and overcomes the problems of the prior art by providing a lift-assisted entrance of lightweight yet sturdy construction that is also architecturally compatible with principal building to which the lift-assisted entrance is attached. The lift-assisted entrance of the present invention is made of molded, lightweight, viscoelastic material and is designed to reflect or be compatible with the architectural style of the principal building to which it is attached, which is typically a residential dwelling, i.e., a house. The lift-assisted entrance frame of the present invention fits on the masonry or concrete basement foundation walls. Mounted on the frame are a front face that has double vertical doors and vertical side walls that support a roof The doors are equipped with a means for securing the doors and the front edge of the roof in a closed position. A lock may be added to the means for securing the doors. The roof of the lift-assisted entrance can be a gabled roof, having a pitch reflecting the roofline of the house and an appearance of roof tiles; the side walls and vertical doors can reflect the style of the house in appearance and also include windows. The roof has a fixed section, attached to the house, and a pivoting section that can tilt upward and away from the doors. Actuators mounted on the lift-assisted entrance roof and side walls lift the front end of the pivoting section of the roof above the vertical doors upward while the opposite end of the roof pivots back over the fixed section of the roof The pivot means may be hinges or pivot pins, and can be easily disengaged to allow the pivoting section of the roof to be removed entirely from the lift-assisted entrance. The vertical doors open out, providing ready access to the stairs leading to the basement doorway.

The panels for the side walls and the vertical doors can be molded with a relief pattern to emulate the appearance of the outer walls of the house, for example, they may have the appearance of shingles or clapboards. The roof is also made of molded, viscoelastic material and it too can be molded with a relief pattern, this pattern emulating the appearance of roof shingles. Windows can be included in the side walls. Rather than reflecting or complementing the style of a house, the lift-assisted entrance could reflect a nautical theme and have a rounded roof and portholes instead of rectangular windows.

When the lift-assisted entrance of the present invention is closed, it protects the subterranean basement entryway completely from the elements of the weather; when it is open it provides easy access to the stairway leading to the basement doorway. Furthermore, the lift-assisted entrance of the present invention reduces the danger of injury that is present with the types of bulkheads of the BILCO or Lyons design. The doors on the lift-assisted entrance of the present invention are vertical and open outward, in the same manner as the doors to which we are accustomed in houses and other buildings, and eliminate the danger of injury due to a suddenly falling door. Furthermore, the lift-assisted entrance of the Preferred Embodiment has a peaked roof, providing ample headroom and thus reducing the risk of the user hitting his or her head on the roof of the lift-assisted entrance when using the stairway. Moreover, the lift-assisted entrance of the present invention reduces the risk of strain or injury, particularly to the lower back of the person seeking access to the basement entryway, because it is not necessary to bend to just a few inches above the ground to lift a heavy door. After unlatching the doors, the roof can be easily grasped on the front end and pushed upward. The front end of the roof is at a level that is convenient to grasp, thereby eliminating the need for the user to stoop. Actuators attached to the roof and to the side walls provide a lift-assist and raise the roof to a height that allows unencumbered access to the basement entryway.

DETAILED DESCRIPTION OF THE PREFERRED EMBODIMENT

Figure 1:
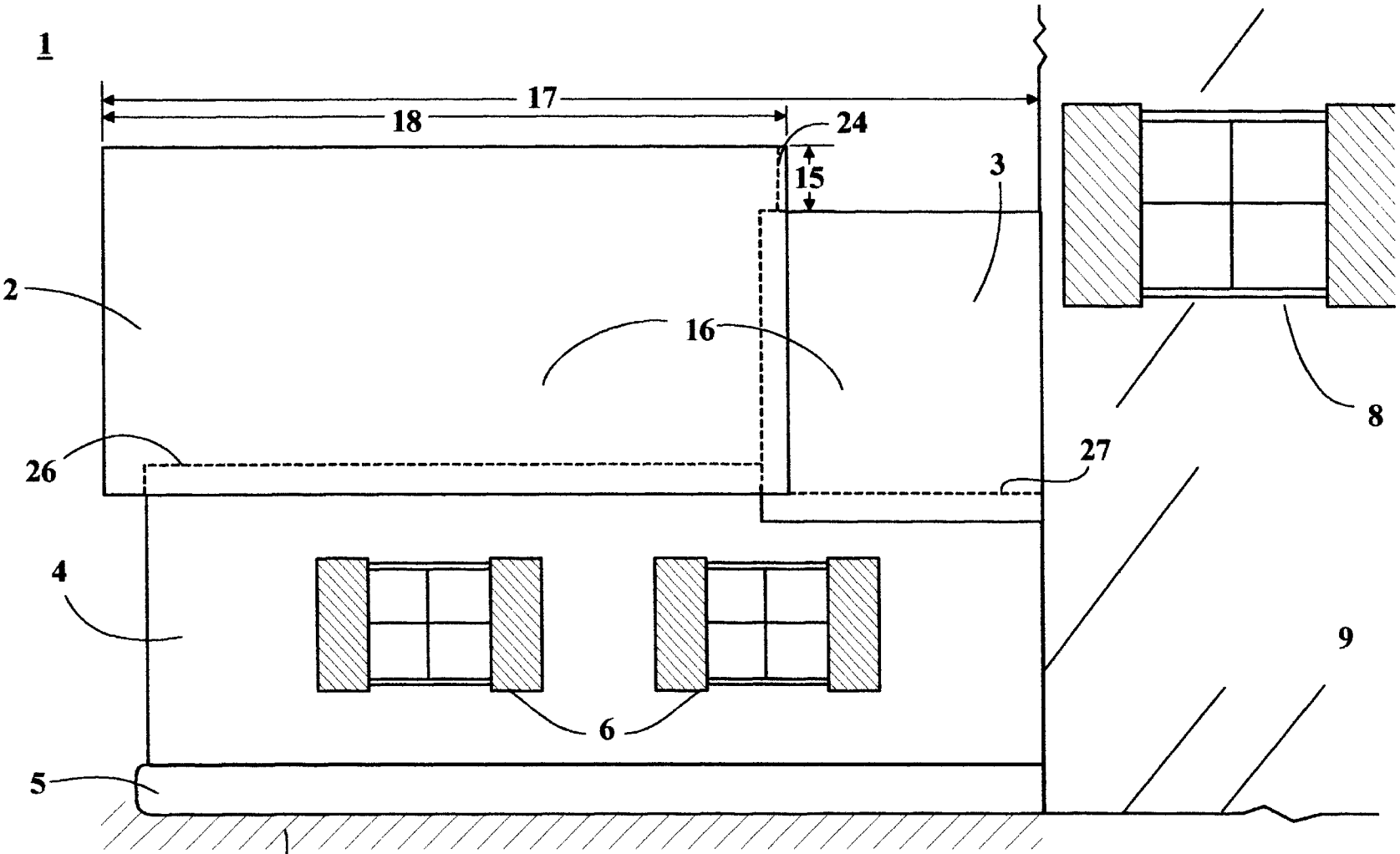
FIG. 1 is a side view of the present invention, with the roof closed, coupled to the principal building.
Figure 2:
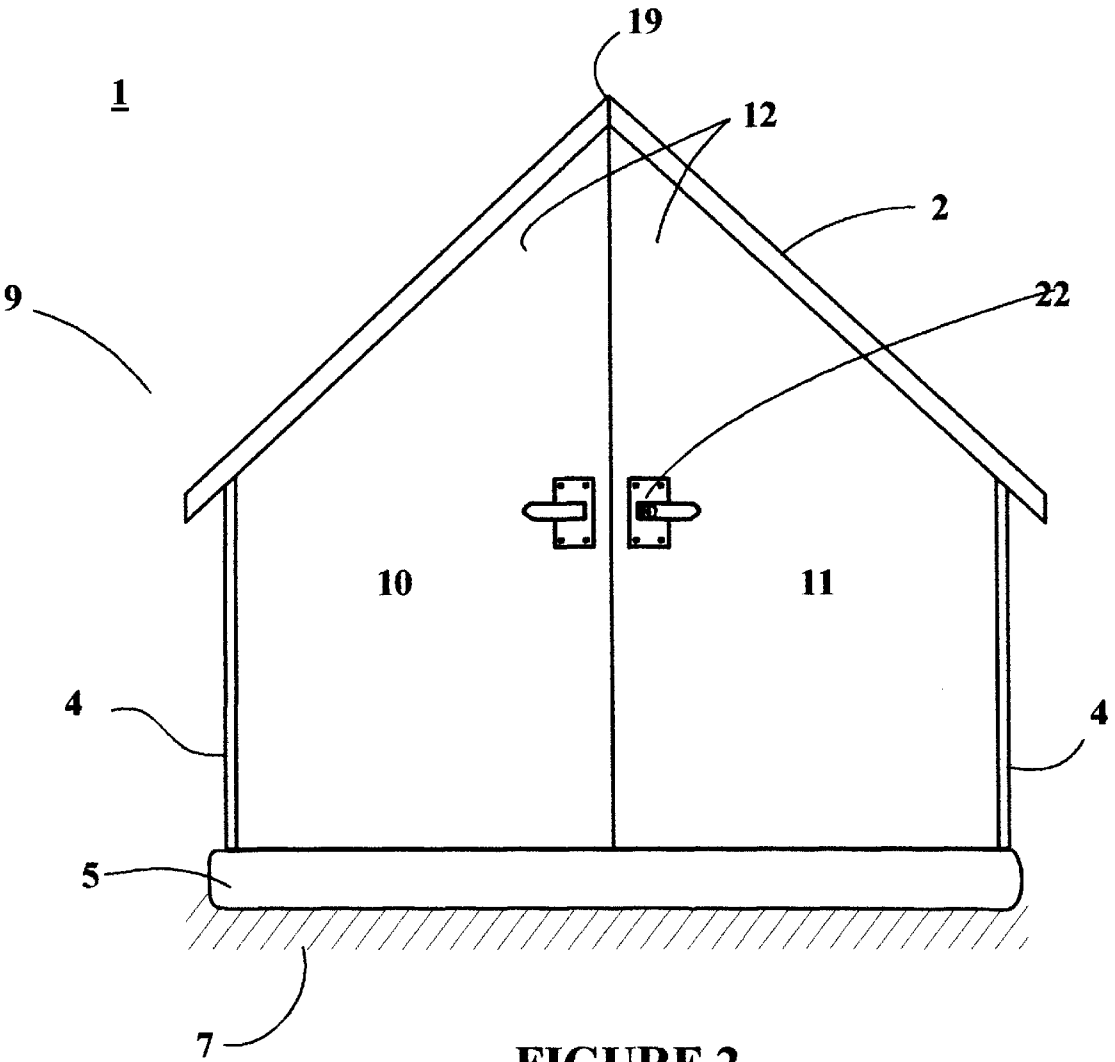
FIG. 2 is font view of the present invention.

The Preferred Embodiment of the present invention is a lift-assisted entrance 1. A front elevation view of the lift-assisted entrance 1 is shown in FIG. 2 and a side elevation view shown in FIG. 1. The lift-assisted entrance 1 is joined to a concrete or masonry foundation wall 5 for the basement entryway, which rises slightly above ground level 7, and to an exterior wall of the principal building 9, which, for the Preferred Embodiment of the present invention, is a private residence. The lift-assisted entrance 1 has two side walls 4, a front face 12 that includes two vertical doors 10 and 11, and a roof 16 that includes a pivotable roof section 2 and a stationary roof section 3. In its Preferred Embodiment, the lift-assisted entrance 1 is made of panels molded from sturdy, visco-elastic material that can withstand the elements of the weather and can be painted.

In its Preferred Embodiment, the design of the lift-assisted entrance 1 reflects the architectural style of a gabled house. The roof 16 has a roof peak 19, as can be seen in FIG. 2. The vertical doors 10 and 11 extend upward to the height of the roof peak 19. When the pivotable roof section 2 is in the closed position, its side edge [no.] and front edge 21 rest atop the side walls 4 and the front face 12, respectively. The vertical doors 10 and 11 are equipped with a handle 22 that includes a latching means (not shown) that will hold the doors in a securely closed position and will also secure the roof to the front face 12. Latching means for this purpose are well-known in the field and thus do not constitute part of this invention and are not described in detail herein.

Figure 3:
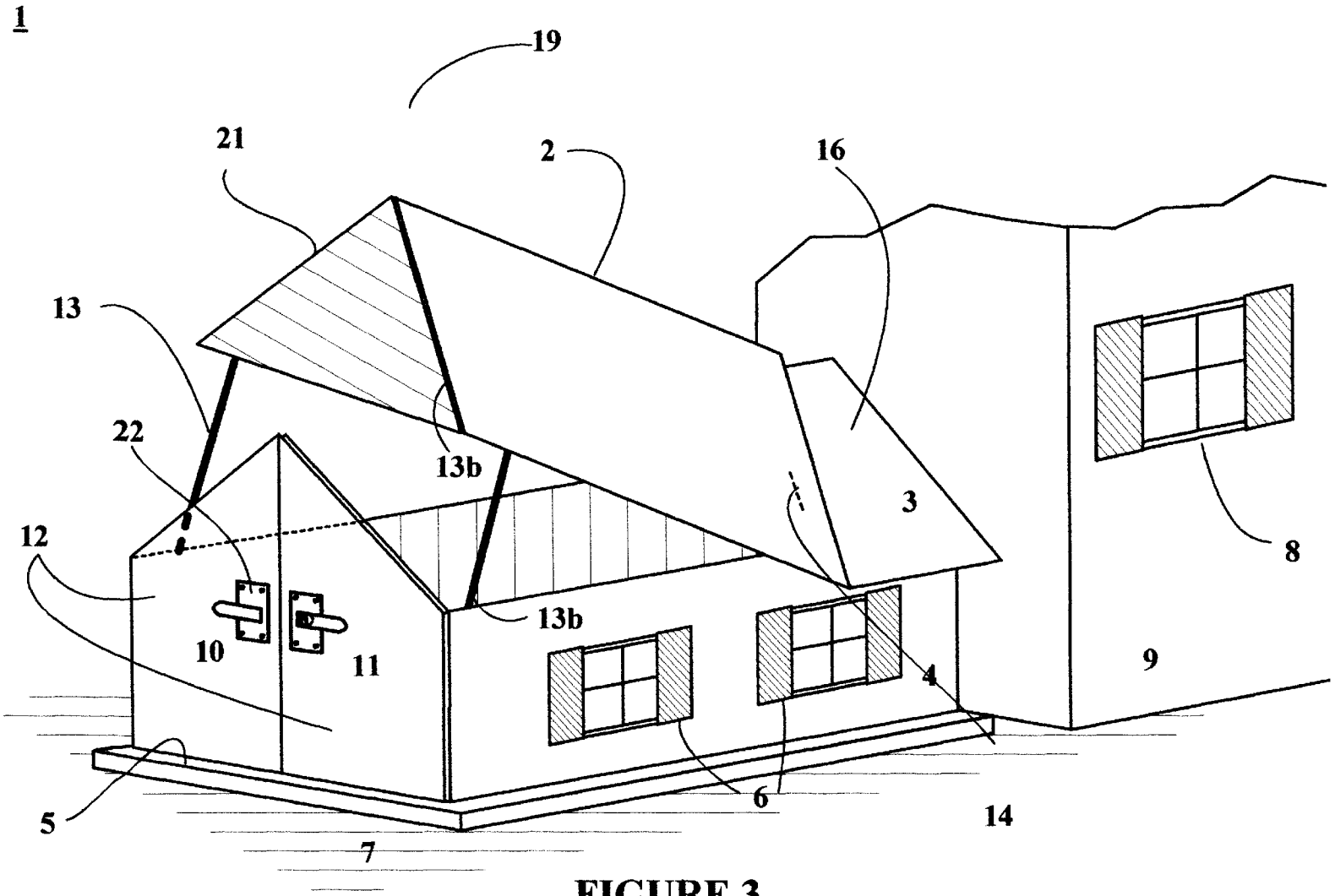
FIG. 3 is a perspective view of the present invention showing the roof partially raised.

In the Preferred Embodiment, the doors 10 and 11 are of a height that the front edge 21 of the pivotable roof section 2 can be readily grasped without bending or stooping. When the latching means is released, the user can raise the pivotable roof section 2 away from the front face 12 by grasping the front edge 21 and pushing upward. FIG. 3 is a perspective view of the lift-assisted entrance 1 showing the pivotable roof section 2 partially raised. As can be seen in FIG. 1, length 18 of the pivotable roof section 2 comprises about 80% of a total length 17 of the roof 16. Also shown in FIG. 1 is a roof height differential 15, the stationary roof section 3 being lower in height than the pivotable roof section 2. The roof height differential 15 provides the necessary space to allow the pivotable roof section 2 to pivot back over the stationary roof section 3. As shown in FIG. 3, the pivotable roof section 2 can pivot about pivot means 14, mounted on each of the side walls 4, and slide back over stationary roof section 3. The pivot means 14 can be a hinge, a pivot pin, a spring-actuated lever, or other type of fastener that will allow the pivotable roof section 2 to pivot up and away from the doors 10 and 11 and slide back over the stationary roof section 3. In the Preferred Embodiment, the pivot means 14 is a pivot pin. When the pivot means 14 is a hinge or lever, the roof differential 15 may be reduced substantially or eliminated. Also shown in FIG. 3 are actuators 13. A lower end 13*a* of the actuator 13 is attached to the front face 12 and an upper end 13*b* to the pivotable roof section 2. Once the user has initiated lifting the pivotable roof section 2, the actuators 13, which may be pneumatically or hydraulically activated, lift the pivotable roof section 2 of the roof 16 upward to a fully opened position without further manual effort. Furthermore, the actuators 13 stabilize the pivotable roof section 2 in its fully deployed position. Easy access to the basement entryway can then be obtained by opening doors 11 and 12 outward. On some occasions, it may be necessary to remove the pivotable roof section 2 from the lift-assisted entrance 1 in order to transport very large or very long objects into the basement entryway. In the Preferred Embodiment, the pivot means 14 and the actuators 13 can be easily disengaged, thus allowing the pivotable roof section 13 to be lifted entirely from the lift-assisted entrance 1 to provide access to the basement entryway that is unencumbered by the pivotable roof section 2.

It is a critical feature of the lift-assisted entrance 1 of the present invention to prevent the ingress of water, snow, hail, or other debris into the basement entryway. In the Preferred Embodiment, means are provided for sealing the mating surfaces of the roof 16 along the side walls 4 and the front edge 12 so as to prevent moisture or debris from seeping through the lift-assisted entrance 1 into the basement entryway. These means may include a lip that extends from one mating surface over the other, or a channel that collects water or debris and carries it away from the lift-assisted entrance 1. Such means for sealing a structure against the ingress of water and debris are well known in the field and are not described in greater detail herein.

In the Preferred Embodiment, windows 6, which reflect the architectural features 8 found on the principal building 9, are located on the side walls 4 of the lift-assisted entrance 1, as shown in FIG. 1 and FIG. 3. Although not shown, additional architectural features, such as clapboard siding or shingles, may also be reflected by a molded relief pattern in the panels that make up the side walls 4 and the front face 12. Similarly, the panels used for the roof 16 of the lift-assisted entrance 1 may be molded with a relief pattern that has the appearance of roof shingles.

It should be understood that the Preferred Embodiment described herein is merely illustrative of the present invention. Numerous variation in design and use of the present invention may be contemplated in view of the following claims without straying from the intended scope and field of the invention.

What is claimed is:

1. A lift-assisted entrance adapted to provide shielded access, from a ground level to a below-ground entryway to a building, said below-ground entryway having a foundation wall and said building having an exterior wall and a plurality of architectural features, said lift-assisted entrance comprising:

a first side wall and a second side wall, each of said first side wall and said second side wall having a lower edge, a front edge, a top edge, and a rear edge, said lower edge being cap of being joined to said foundation wall and said rear edge being capable of being joined to said exterior wall of said building, said top edge being substantially parallel to said lower edge and said rear edge substantially parallel to said front edge;

a front face, said front face having a lower front face edge, said lower front face edge being capable of being joined to said foundation wall, a first front face side edge coupled to said front edge of said first wall, a second front face side edge coupled to said front edge of said second side wall, and at least one door, said door being substantially vertically oriented and hingedly connected to one of said first front face side edge or said second front face side edge such that said door opens outward; and a roof, said roof including a pivotable roof section, a stationary roof section, and a pivot means;

wherein said top edge of said first side wall and said second side wall has a front top edge and a rear top edge and said pivotable roof section is coupled to said front top edge and said stationary roof section coupled to said rear top edge so as to position said stationary roof section lower than said pivotable roof section, wherein a pivoting rear edge of said pivotable roof section is pivotably coupled by said pivot means, said pivot means including a first pivot means coupled to said pivotable roof section and to said front top edge of said first side wall at a first pivot point located at a predetermined distance from said first front edge and a second pivot means coupled to said pivotable roof section and to said front top edge of said second side wall at a second pivot point located at said predetermined distance from said second front edge, wherein a first stationary roof edge is immovably coupled to said rear top edge of said first side wall and a second stationary roof edge is immovably coupled to said rear top edge of said second side wall, wherein an installation edge of said stationary roof section is capable of being coupled to said exterior wall of said building, wherein, when said pivotable roof section is in a closed position, a front-facing edge of said stationary roof section has a lip extending upward to mate with said pivoting rear edge of said pivotable roof section and a front-facing edge of said pivotable roof section is releasably coupled with said front face, so as to form a water-tight joint between said stationary roof section and said pivotable roof section and between said roof and said front face and said first side wall and said second side wall.

2. The lift-assisted entrance as described in claim 1 wherein said pivotable roof section has a first roof peak interior angle of less than 180 degrees and said stationary roof section has a second roof peak interior angle substantially equal to said first roof peak angle.

3. The lift-assisted entrance as described in claim 1 wherein said pivotable roof section has a first slightly rounded roofline and said stationary roof section has a second rounded roofline substantially equal to said first roofline.

4. The lift-assisted entrance as described in claim 1 further comprising at least one extendable support means, said support means having a first end pivotably couplable to one of said first pivotable roof side or said second pivotable roof side, and a second end pivotably couplable to one of said first side wall or said second side wall.

5. The lift-assisted entrance as described in claim 4 wherein said extendable support means is an actuating means, said actuating means raising and supporting said roof in an open position.

6. The lift-assisted entrance as described in claim 4 wherein each of said first side wall and said second side wall include at least one of said architectural features.

7. The lift-assisted entrance as described in claim 6 wherein said architectural feature is a window.

8. The lift-assisted entrance as described in claim 4 wherein said pivot means and said extendable support means are readily decouplable so as to allow said pivotable roof section to be removed from said lift-assisted entrance.

9. The lift-assisted entrance as described in claim 8 wherein said pivot means is a pivot pin assembly.

10. The lift-assisted entrance as described in claim 8 wherein said pivot means is a hinge assembly.

11. The lift-assisted entrance as described in claim 8 wherein said pivot means is a spring-actuated lever.

12. The lift-assisted entrance as described in claim 1 wherein said root said first side wall, said second side wall, and said front face are fabricated from a visco-elastic material.

13. The lift-assisted entrance as described in claim 12 wherein said first side wall, said second side wall, and said front face are molded in a relief pattern that emulates a type of siding used on said exterior wall of said building.

14. The lift-assisted entrance as described in claim 12 wherein said roof is molded in a roof shingle relief pattern.

15. A lift-assisted entrance adapted to provide shielded access, from a ground level to a below-ground entryway to a building, said below-ground entryway having a foundation wall and said building having an exterior wall and a plurality of architectural features, said lift-assisted entrance comprising:

a first side wall and a second side wall, each of said first side wall and said second side wall having a lower edge, a front edge, a front top edge, a rear top edge, and a rear edge, said lower edge being capable of being joined to said foundation wall and said rear edge being capable of being joined to said exterior wall of a building, said front top edge and said rear top edge being substantially parallel to said lower edge and said rear edge substantially parallel to said front edge;

a front face, said front face having a lower front-face edge, said lower front-face edge being capable of being joined to said foundation wall, a first front-face side edge coupled to said front edge of said first wall, a second front-face side edge coupled to said front edge of said second side wall, and at least one door, said door being substantially vertically oriented and hingedly connected to one of said first front face side edge or said second front face side edge such that said door opens outward;

a roof having a pivotable roof section, a stationary roof section, and a pivot means, wherein said pivotable roof section has a pivotable roof length dimension, a first pivot means pivotably coupling a first pivotable roof edge to said first side wall at a first pivot point, and second pivot means pivotably coupling a second pivotable roof edge to said second side wall at a second pivot point, said first pivot point and said second pivot point being located at a predetermined distance from said first front edge and said second front edge, respectively, wherein said pivotable roof section has a first roof peak interior angle that is less than 180 degrees, and wherein said stationary roof section has a stationary roof length dimension that is 25% of said pivotable roof length dimension, a first stationary roof edge being joined to said rear top edge of said first side wall, and a second stationary roof edge being joined to said rear top edge of said second side wall, and said stationary roof section has a second roof peak interior angle that is substantially equal to said first roof peak interior angle;

a first extendable actuating means having a first end pivotably coupled to said pivotable roof section and a second end coupled to said first side wall, and a second extendable actuating means having a third end pivotably coupled to said second panel of said pivotable roof section and a fourth end coupled to said second side wall;

wherein each of said first side wall and said second side wall includes a window;

wherein said pivotable roof section, said stationary roof section, said first side wall, said second side wall, and said front face are fabricated from a visco-elastic material.

16. The lift-assisted entrance as described in claim 15 wherein said first side wall, said second side wall, said front face are molded with a relief pattern emulating the appearance of house shingles.

17. The lift-assisted entrance as described in claim 16 wherein said roof is molded with a relief pattern emulating the appearance of roof shingles.

* * * * *